United States Patent [19]

Tucker

[11] Patent Number: 5,045,374

[45] Date of Patent: Sep. 3, 1991

[54] DRYWALL EDGE FINISHING STRIP

[76] Inventor: Richard E. Tucker, 8161 La Monte Rd., Anaheim, Calif. 92804

[21] Appl. No.: 492,138

[22] Filed: Mar. 13, 1990

[51] Int. Cl.[5] ..... E04B 2/00

[52] U.S. Cl. ..... 428/83; 52/371; 428/122; 428/192

[58] Field of Search ..... 428/192, 83, 122, 134, 428/136; 52/371, 416, 417

[56] References Cited

U.S. PATENT DOCUMENTS

| | | | |
|---|---|---|---|
| T887,014 | 6/1971 | Overbay et al. | 52/417 X |
| 1,444,731 | 2/1923 | Clark | 52/672 |
| 2,314,523 | 3/1943 | Speer | 52/417 |
| 2,904,856 | 9/1959 | Robinson | 52/255 |
| 2,974,078 | 3/1961 | Petritz et al. | 52/417 |
| 3,091,821 | 6/1963 | Cook, Jr. | 428/100 |
| 3,109,207 | 11/1963 | Cooper | 52/255 |
| 3,201,908 | 8/1965 | Arnold | 52/255 |
| 3,201,910 | 8/1965 | Keesee | 428/192 X |
| 3,345,788 | 10/1967 | Holsman | 52/371 X |
| 3,398,494 | 8/1968 | Larson | 52/371 |
| 3,408,250 | 10/1968 | Finefrock | 428/40 X |
| 4,054,698 | 10/1977 | Hamrah | 428/192 X |
| 4,153,230 | 5/1979 | Giacin | 428/192 X |
| 4,202,449 | 5/1980 | Bendt | 428/192 X |
| 4,378,394 | 3/1983 | Miura et al. | 428/113 |
| 4,496,617 | 1/1985 | Parker | 428/55 |
| 4,601,149 | 7/1986 | Dokan | 428/100 X |
| 4,863,774 | 9/1989 | Tucker | 428/77 |

FOREIGN PATENT DOCUMENTS

| | | | |
|---|---|---|---|
| 520145 | 6/1953 | Belgium | 428/182 |
| 686254 | 5/1964 | Canada | 428/124 |
| 1331354 | 9/1973 | United Kingdom | 428/182 |

*Primary Examiner*—Henry F. Epstein
*Attorney, Agent, or Firm*—Charles H. Thomas

[57] ABSTRACT

A stiff plastic strip is formed to provide reinforcement for longitudinal edges at which interior drywall surfaces meet and for capping corners formed of sheets of wallboard meeting at orthogonal angles. A pair of laterally directed flanges extend in diverging fashion from a central transversely curved region of the plastic strip. A contact sensitive adhesive strip is mounted on each of the flanges to extend longitudinally therealong so as to allow the plastic strip to be pressed against drywall or wallboard surfaces. One of the flanges of the plastic strip may be slit periodically throughout its length to allow it conform to arches and circular openings. In another embodiment a stiff, water impervious plastic sheet with three flanges extending outwardly therefrom has contact sensitive adhesive layers disposed on each of the flanges. The structure can thereby serve as a cap for protruding soffit corners.

19 Claims, 3 Drawing Sheets

DRYWALL EDGE FINISHING STRIP

BACKGROUND OF THE INVENTION

1. Field of the Invention

The present invention relates to an improved drywall edge finishing structure for use in covering edges and corners of interior building walls constructed of wallboard panels.

2. Description of the Prior Art

In current building construction techniques, sheets of drywall, sometimes called wallboard, are widely used to form the surfaces of interior walls of residential, commercial and industrial buildings. Drywall has widely replaced plaster as the standard interior building wall fabrication material due to the speed and ease with which it can be installed. Drywall, or wallboard, is formed of sheets of plaster which are sheathed in an outer wrapping of heavy construction paper. Large sheets of drywall are typically provided at the construction site in sizes of four feet by eight feet or four feet by twelve feet. The drywall sheets are sometimes installed intact, but it is usually necessary to cut them to size to form interior building walls.

Drywall tape is widely used in the building construction industry as a means for covering the crevices between abutting panels of drywall. Conventional drywall tape is provided in narrow, elongated ribbons or strips of porous paper wound into rolls. The paper is sometimes perforated in increase moisture penetration and to prevent air bubbles from being entrapped behind the tape. The drywall tape is first applied to joints and edges of abutting drywall panels and is then covered with wet plaster, sometimes called "mud". The plaster is feathered and smoothed along the edges of the tape to conceal the demarcations between the tape edges and the drywall panels to which the tape is applied. Once the wet plaster has dried the tape and the drywall can be pained or otherwise covered with a suitable wall covering. Because drywall tape is formed of paper it is quite flexible and will conform to various surface configurations of the edges of intersecting panels of drywall.

While the edges, as well as the flat, expansive surfaces of sheets of drywall are originally covered with heavy paper, the edges of encapsulated sheets of plaster therewithin are exposed where the sheets of drywall are cut to size. When the severed edges of the drywall sheets are exposed, the exposed plaster does tend to crumble unless the severed edges are somehow protected. This is especially important at exterior wall edges where wall surfaces meet within the interior of a building. Such exterior edges define doorways and window openings, in contradistinction to interior edges, such as those formed by intersecting drywall panels in the corner of a room, for example. That is, exterior edges are those edges in which the building walls encompass an angle of less than 180 degrees, while in an interior edge the building walls encompass a reflex angle.

When conventional drywall tape is used at the exterior edges of walls, however, the flexibility of the tape often results in a corner demarcation which is irregular, since the tape does conform to irregularities in the exposed, severed edges of the drywall panels. As a consequence, conventional drywall tape is often not used at exposed exterior corners.

To finish exterior edges in building construction, metal corner beads are often employed. Conventional metal beads are configured in an L-shaped or angle-shaped cross section and are typically fabricated from elongated perforated strips of metal, such as galvanized steel, permanently deformed with a lengthwise 90 degree bend to form elongated angles. The metal beading is typically positioned at the intersections of adjacent drywall panels which meet at right angles to form an exterior edge within a room. The sections of metal beading are nailed in place through the drywall panels to wooden supporting structural members located behind the drywall panels. Wet plaster is then smoothed into place to cover the metal bead or leg members of the metal beading, and the edges of the plaster are smoothed and feathered to attempt to conceal the metal edges.

While the rigidity of the metal beading does allow an exterior corner of an interior building wall to be finished with a sharp, straight edge which is aesthetically pleasing, the use of metal beading involves several significant problems. Specifically, since the adjacent angle flanges of the metal beading are rigid so as to preserve the straight, linear configuration of the apex of the beading, the metal beading will only conform to straight, linear edges formed by orthogonal sections of drywall panels. The metal beading will not conform to drywall edges which are cut in an arcuate shape to form, for example, an arched doorway.

Also, the flanges of the metal beading are significantly stiffer than paper drywall tape, and do not always readily lay flat against the surfaces of the drywall. Consequently, the flanges of the metal beading can be concealed only with the application of a considerably greater amount of wet plaster, as compared with the amount of wet plaster required to conceal conventional drywall tape. This results in both an increased material cost as well as a substantially increased labor cost. Moreover, at locations where the flanges of the metal corner beads do not reside in intimate contact with the drywall surface, the dried plaster between the flanges of the metal bead and the drywall will tend to crumble, particularly if any pressure is exerted on the flanges of the metal corner bead. Furthermore, over a period of time the metal corner bead will rust, thereby producing rust stains which are clearly visible on the surfaces of the walls at the edges thereof.

A further disadvantage of conventional drywall edge finishing systems is that the edge finishing structures, such as metal beading, must be held in position and nailed into place. Frequently nails which are pounded into the flanges of the metal beading do not strike solid structural supports behind the wallboard, but rather pass outside or between solid supports such as studs and joists. As a consequence, conventional beading is not always adequately anchored against the wall. Portions of the flanges of such metal beading will thereupon separate from the wallboard against which the beading is disposed, thereby creating cracks running parallel to the intersecting wall edges covered by the beading in the wall finish. Such cracks give an unsightly appearance to the finished wall surface of a room.

SUMMARY OF THE INVENTION

In one broad aspect the present invention is a drywall edge strip comprising an elongated length of stiff, water impervious plastic defining an elongated central transversely curved region and a pair of laterally directed flanges that extend in diverging fashion from the central curved region, and a layer of pressure sensitive adhesive on each of the flanges extending longitudinally therealong. The stiff, length of plastic has sufficient rigidity to sharply define the edge intersections of wall surfaces, but is flexible enough to conform to minor undulations, depressions and slight irregularities in the wall surfaces. Moreover, the length of plastic is sufficiently flexible to readily conform to edges which are intentionally curved, such as at doorway arches and circular windows.

By providing the flanges with a contact sensitive adhesive, the flanges are securely attached to the intersecting wall surfaces, and will not separate from those surfaces. Intimate contact between the flanges of the drywall edge finishing strip and the wall surfaces is not dependent upon the presence of some solid, supporting structure, such as a stud or joist behind the drywall. The drywall edge finishing strip of the invention is therefore not subject to intermittent separations from the wall surfaces that sometimes occur between the flanges of conventional edge finishing strips where nails passing therethrough do not encounter a hard supporting structure behind the drywall. To the contrary, the secure attachment of the flanges of the drywall edge finishing strip of the invention is a result of the adhesion between the contact sensitive adhesive and the wall surface against which the adhesive strip is placed. Since the stiff, elongated plastic strip is sufficiently flexible to accommodate minor irregularities in the wall surface, an intimate bonding of the flanges of the elongated plastic strip can be established throughout the length of the strip on both sides of the central region thereof.

A further advantage of the drywall edge finishing strip of the invention is the ease with which it may be attached to the intersecting wall surfaces at which it is positioned. The flanges of the elongated, stiff length of plastic need merely be pressed firmly against the wall surfaces to which they are to be joined. This pressure causes the contact sensitive adhesive to establish a firm bond that holds the flanges permanently in position. The installation of the plastic strips proceeds much more rapidly than the installation of conventional drywall beading, since there is no necessity to hold the elongated plastic strips in position while pounding nails through the flanges and into firm supports located behind the wallboard.

In another broad aspect the present invention is a drywall edge finishing strip comprising an elongated length of stiff, water impervious plastic defining an elongated central transversely curved region and a pair of laterally directed flanges that diverge from the central curved region to define longitudinally extending edges, and wherein one of the flanges is slit periodically throughout its length by a multiplicity of parallel slits that extend transversely from the longitudinally extending edges into the central region. By providing one of the two flanges with longitudinally spaced, transverse slits, the edge finishing strip is better able to accommodate and adhere to wall surfaces that intersect in other than an orthogonal fashion. For example, by providing one of the flanges of an elongated, stiff plastic strip according to the invention with a multiplicity of transverse, parallel slits, the drywall edge finishing strip can readily follow curved edges, such as arcuate archways. Indeed, a strip according to the invention can even follow circular openings, such as porthole-type windows, as small as twelve inches in diameter.

Still another aspect of the present invention is a drywall edge finishing structure comprising a stiff, water impervious plastic sheet defining a central curved region and at least a pair of flanges extending outwardly from the central region and at angles to each other, and a contact sensitive adhesive layer disposed on each of the flanges. While such a structure may be formed as an elongated wall edge finishing strip of the type previously described, it may also be formed as a cap for an exposed corner formed by intersecting wall surfaces, such as exposed corners of a soffit, for example. The contact sensitive adhesive layers on each of the flanges hold the stiff plastic sheet in position against the intersecting wall structures regardless of the complexity of the shape of the wall structures. Such drywall edge finishing sheets may also be utilized at the interior corners of a room so as to provide smoothly curved corners formed by three walls intersecting at orthogonal angles. This facilitates cleaning and reduces the extent to which dirt and grime accumulate in corners that are otherwise completely orthogonal.

The drywall edge finishing strips or sheets which are utilized according to the invention are not limp and completely flexible like conventional drywall tape, nor are they extremely rigid like metal corner beading. The lengths or sheets of the stiff, water impervious plastic are constructed of a durable plastic, preferably extruded styrene, polyurethane, ABS, or an acrylic plastic. The elongated plastic lengths are formed with opposite longitudinal edges that are parallel to each other at the outer extremities of the flanges.

In those embodiments of the invention provided with a multiplicity of parallel slits, the slits are preferably longitudinally spaced from each other at intervals of approximately one and one-quarter inches and are preferably inclined at an angle relative to the longitudinal edges of the flanges into which the slits are defined. The slits formed in one of the flanges of each strip are preferably inclined at an angle of about seventy degrees relative to the longitudinal edge of the flange in which they are defined. The slits can thereby be greater in length to provide greater adaptability to more pronouncely curved surfaces without overly weakening the structure of the strips. Preferably, these slits all extend more than half the distance across the entire width of the plastic strip to provide a drywall edge finishing strip of considerable limberness without being completely soft and shapeless.

In some applications it is desirable to form the plastic strip of the invention with a longitudinally extending stiffening bead in the central region. The bead then extends parallel to the longitudinal edges of the drywall edge finishing strip of the invention. The bead stiffens the central region of the edge finishing strip which often requires stiffening since it does not reside in contact throughout with a wall surface. The stiffening bead is located on the side of the strip facing the wall surfaces, so that it does not form an unsightly protrusion out away from the wall surfaces. To the contrary, it is hidden behind the smooth concave or convex exposed surface of the central region and performs its stiffening function while hidden from view.

It is sometimes advisable to form the longitudinal edges of the flanges such that the thickness of the flanges tapers away from the central region and toward the longitudinal edges. The flanges are thickest where they diverge from the central region and are at their thinnest adjacent the longitudinal edges. This tapered cross sectional flange configuration allows the drywall edge finishing strips to be blended smoothly into the interior portions of the drywall surfaces to which they are secured remote from the intersecting edges thereof.

Preferably also, the plastic strip of the invention is configured so that the central region stands out away from the flanges and is delineated therefrom by parallel tape guide abutment shoulders on opposite sides of the central region. The tape guide abutment shoulders provide a rail or seat against which conventional paper drywall tape may reside in abutting fashion. Such tape may be used to blend the edges of the flanges of the drywall edge finishing strip of the invention into the adjacent expansive wall structure.

The invention may be described with greater clarity and particularity with reference to the accompanying drawings.

DESCRIPTION OF THE EMBODIMENT

Figure 1:
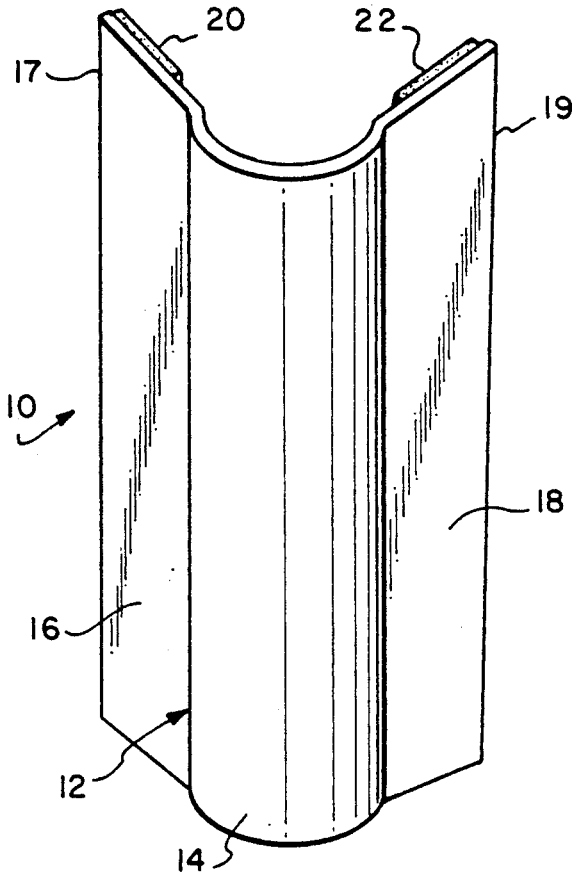
FIG. 1 is a perspective view of one embodiment of a drywall edge finishing strip according to the invention.

FIG. 1 illustrates a drywall edge finishing strip indicated generally at 10 comprised of an elongated length 12 of stiff, water impervious plastic. The plastic length 12 may be formed of extruded styrene, polyurethane, ABS or acrylic, for example. The elongated length 12 defines a central, transversely curved region 14 and a pair of laterally directed flanges 16 and 18 that extend in diverging fashion from the central transversely curved region 14. The flanges 16 and 18 extend out away from the transversely curved region 14 and respectively terminate in parallel longitudinal edges 17 and 19. As illustrated in the perspective view of FIG. 1, the edge finishing strip 10 is provided with a pair of pressure sensitive adhesive strips 20 and 22 each between about 0.0625 and 0.010 inches in thickness. The adhesive strips 20 and 22 are respectively mounted on the flanges 16 and 18 to extend longitudinally therealong.

The pressure sensitive adhesive strips 20 and 22 are cut from a tape sold commercially as product number 214B by Tuff Industries of La Mirada, Calif. This tape has pressure sensitive adhesive on both sides and is sold commercially in a width of one half inch and in rolls having a length of two hundred sixteen feet. One of the sides of the tape is covered with a non-adhesive ribbon coated. With a release agent. The adhesive strips 20 and 22 are cut to length and pressed against the inner surfaces of the flanges 16 and 18 with the protective ribbon covering the surfaces of the strips 20 and 22 that are not in contact with the flanges 16 and 18. The protective ribbon is removed from the adhesive strips just prior to use of the drywall edge finishing strip 10.

Figure 2:
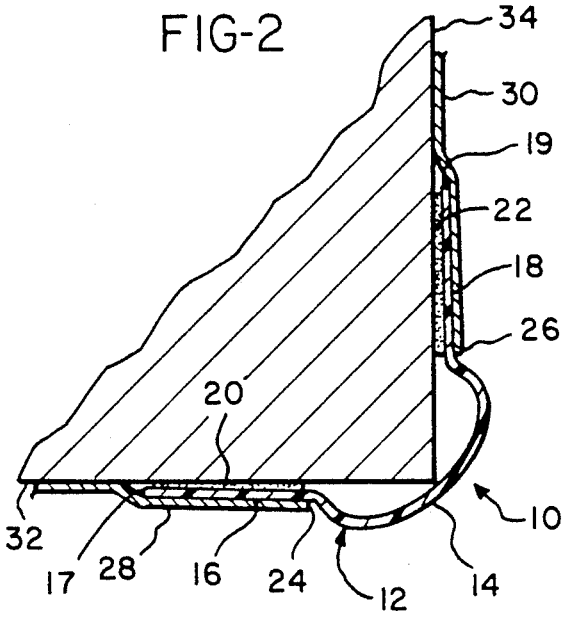
FIG. 2 illustrates in cross section the use of the drywall edge finishing strip of FIG. 1.

As illustrated in FIG. 2, the plastic strip 12 is configured so that the central region 14 stands out away from the flanges 16 and 18 and is delineated therefrom by parallel tape guide abutment shoulders 24 and 26 on opposite sides of the central region 14. The shoulders 24 and 26 provide abutment ledges or stops against which conventional paper drywall tape strips 28 and 30 are disposed following application of the drywall edge finishing strip 10 to an exterior wall edge as illustrated in FIG. 2.

To use the drywall edge finishing strip 10 the protective ribbons covering the adhesive strips 20 and 22 are removed and the drywall edge finishing strip 10 is positioned such that the central region 14 is centered over a linear edge of two intersecting walls 32 and 34. The flanges 16 and 18 are then respectively pressed against the walls 32 and 34, so that the exposed adhesive on the adhesive strips 20 and 22 holds the flanges 16 and 18 tightly against the walls 32 and 34. Thereafter, paper drywall tape strips 28 and 30 are normally placed lengthwise to run parallel to and in lapping relationship on top of the flanges 16 and 18. The paper drywall tape strips 28 and 30 are positioned so that their edges proximate to the central region 14 of the drywall edge finishing strip 12 resides in abutment respectively against the shoulders 24 and 26. The paper tape strips 28 and 30 aid in allowing the drywall edge finishing strip 10 to blend in with the uncovered wall surfaces of the walls 32 and 34. Paste-like plastering mud is then used to further cover and saturate the paper tapes 28 and 30 and to further blend the edge finishing strip 10 in with the wall surfaces 32 and 34.

Figure 3:
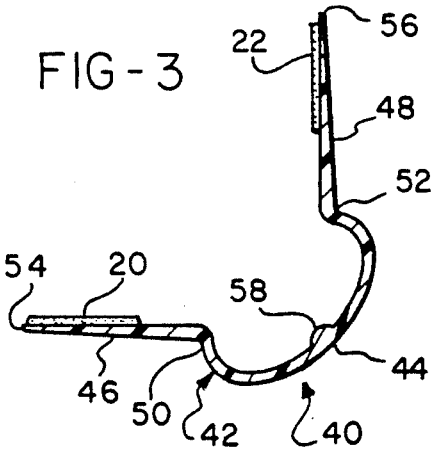
FIG. 3 is a cross sectional view of an alternative embodiment of a drywall edge finishing strip according to the invention.

FIG. 3 illustrates an alternative embodiment of a drywall edge finishing strip 40 constructed according to the present invention. The strip 40, like the drywall edge finishing strip 10, has an elongated length 42 of stiff, water impervious plastic defining an elongated central transversely curved region 44 and a pair of laterally directed flanges 46 and 48 that extend in diverging fashion from the central curved region 14. The flanges 46 and 48 respectively define a pair of mutually parallel longitudinal edges 54 and 56. A pair of pressure sensitive adhesive strips 20 and 22 are mounted on the flanges 46 and 48, respectively, to extend longitudinally therealong. A pair of abutment shoulders 50 and 52 delineate the flanges 46 and 48 from the central region 44 which stands out and away from the flanges 46 and 48.

The drywall edge finishing strip 40 differs from the strip 10 in that the flanges 46 and 48 are tapered in thickness. That is, the flanges 46 and 48 are thickest adjacent the abutment shoulders 50 and 52 and are of decreasing thickness proceeding from the shoulders 50 and 52 outwardly away from the central region 44 toward the longitudinal edges 54 and 56.

A longitudinally extending stiffening bead 58 is defined on the inwardly facing concave surface of the central region 44. The stiffening bead 58 extends parallel to the longitudinal edges 54 and 56 and serves to structurally reinforce the rigidity of the central region 44, since that region stands out and away from the surfaces of the walls against which the flanges 46 and 48 are positioned.

Figure 4:
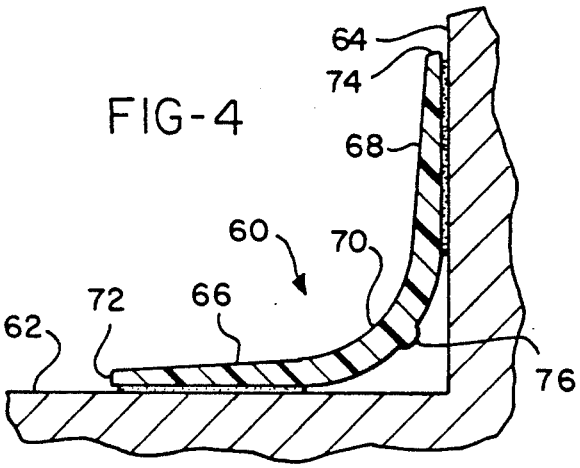
FIG. 4 illustrates yet another alternative embodiment cf a drywall edge finishing strip according to the invention.

The drywall edge finishing strips 10 and 40 are configured to finish the longitudinal exterior edges of wall surfaces that intersect at and enclose an acute angle, and the flanges of the finishing strips 10 and 40 embrace the wall surfaces against which they are positioned within an acute angle. However, a drywall edge finishing strip according to the invention can also be utilized to finish the longitudinal interior edges of wall surfaces that intersect at and enclose a reflex angle, such as the wall surfaces 62 and 64 depicted in FIG. 4. Specifically, a drywall edge finishing strip 60 is provided having a pair of flanges 66 and 68 which are tapered in cross sectional configuration out away from a central region 70 toward longitudinal edges 72 and 74. A thickened portion in the central region 70 is formed as a stiffening bead 76 that faces inwardly toward the wall surfaces 62 and 64. The stiffening bead 76 enhances the rigidity of the central region 70, which as illustrated in FIG. 4, is not directly supported from behind by the wall surfaces 62 and 64.

Figure 5:
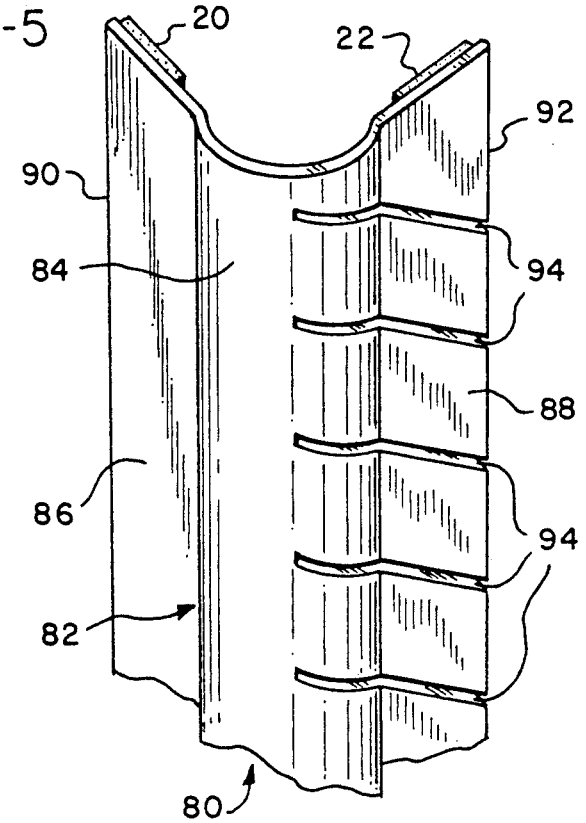
FIG. 5 illustrates yet another alternative embodiment of the drywall edge finishing strip of the invention.

FIG. 5 illustrates a very versatile and useful embodiment of a drywall edge finishing strip 80 according to the invention. The drywall edge finishing strip 80 is comprised of an elongated length 82 of stiff, water impervious plastic that defines an elongated central curved region 84 and a pair of laterally directed flanges 86 and 88. The flanges 86 and 88 diverge from the central curved region 84 to define longitudinally extending edges 90 and 92.

The structure of the edge finishing strip 80 is identical to that of the edge finishing strip 10 with the exception that one of the flanges, the flange 88, is slit periodically throughout its length by a multiplicity of parallel slits 94 that extend transversely from the longitudinally extending edge 92 into the central region 84. The drywall edge finishing strip 80 is comprised of layers of pressure sensitive adhesive tape 20 and 22 that are mounted on both of the interior surfaces of the flanges 86 and 88. These layers of adhesive tape 20 and 22 extend longitudinally along the length of the plastic strip 82 at the edges 90 and 92 thereof. The slits 94 are located at separated intervals along the length of the flange 88 to extend transversely across the flange 88 through the adhesive strip 22 mounted thereon. The slits 94 are longitudinally spaced from each other at intervals of approximately one and one-quarter inches and are inclined at an angle of about seventy degrees relative to the longitudinal edge 92 of the flange 88 in which they are defined. The slits 94 extend more than half the distance across the entire width of the plastic strip 82 so that they terminate within the central region 84 at locations further from the edge 92 of the flange 88 from which they extend then from the opposite longitudinal edge 90 of the flange 86.

Figure 6:
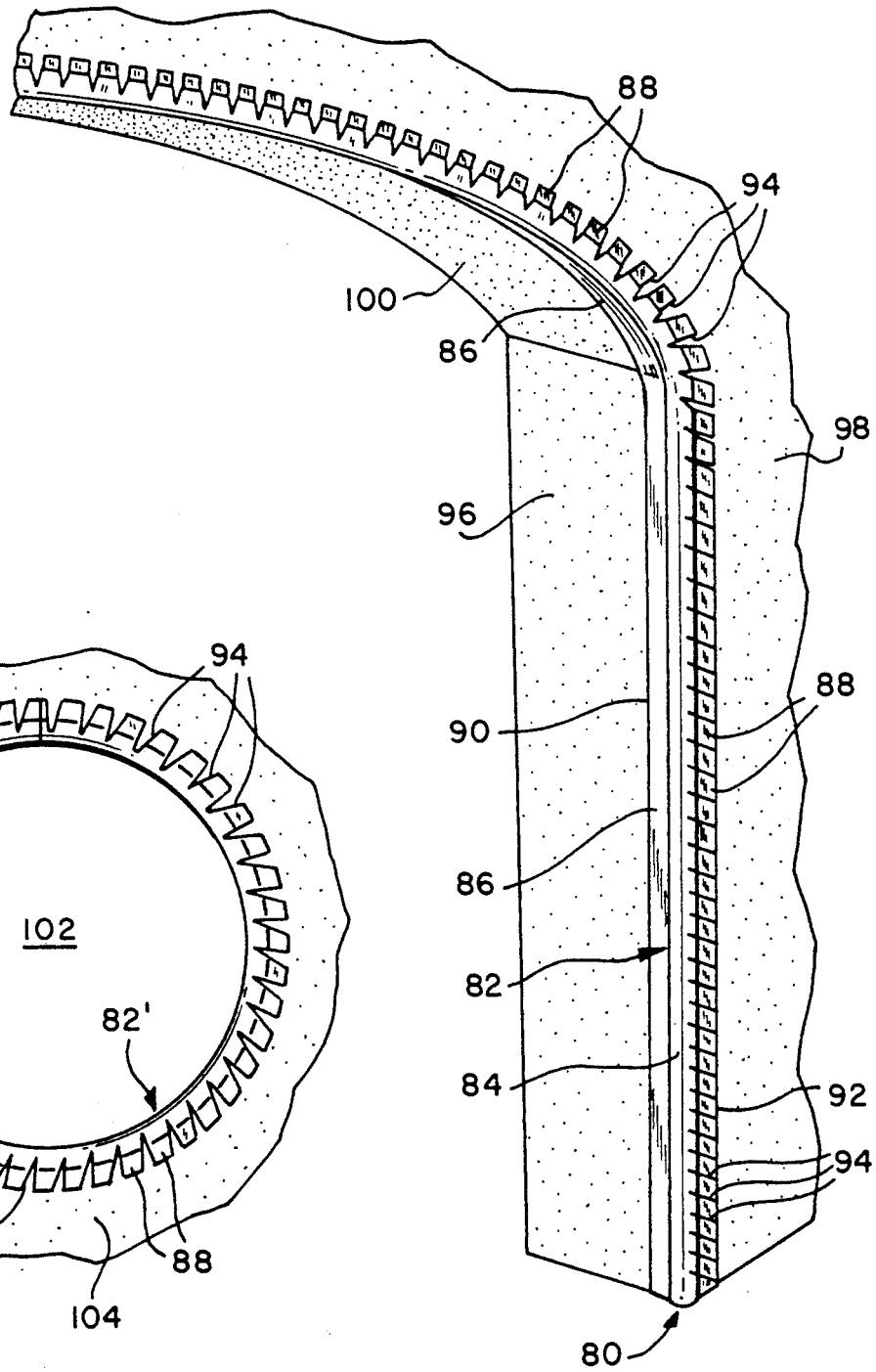
FIG. 6 illustrates one manner of utilization of the drywall edge finishing strip of FIG. 5.

When the drywall edge finishing strip 80 is applied to an exterior edge as depicted in FIG. 6, the layers of adhesive tape 20 and 22 are interposed between the flanges 86 and 88 and the wall surfaces 96, 98 and 100. The adhesive strips 20 and 22 hold their respective flanges securely against those wall surfaces. The drywall edge finishing strip 80 is installed by positioning one end at the lower extremities of the wall surfaces 96 and 98 with the adhesive tape strips on the interiorally facing surfaces of the flanges 86 and 88 facing inwardly toward the wall surfaces 96 and 98. The protective ribbons are removed from the adhesive tape strips progressively from bottom to top, and the flanges 86 and 88 are pressed against the wall surfaces 96 and 98, respectively, proceeding from the lower end of the wall finishing strip 80 to the upper end.

As illustrated in FIG. 6, the wall surfaces 100 and 98 form an arcuately curved archway above the demarcation between the wall surfaces 96 and 100. Since the flange 88 is periodically slit along its length, the strip 80 can be easily bent into an arcuate form to follow this edge curvature. The slits 94 separate the flange 88 into tab-like sections between the slits. Above the wall surface 96 these tab-like sections spread apart at the slits 94 as required by the curvature of the archway so that the flanges 86 and 88 readily follow and reside in intimate contact with the wall surfaces 100 and 98, respectively. If desired, the flanges 86 and 88 can be covered with overlapping strips of conventional drywall paper tape in order to allow the drywall edge finishing strip 80 to more readily blend into the wall surfaces 96, 98 and 100.

Figure 7:
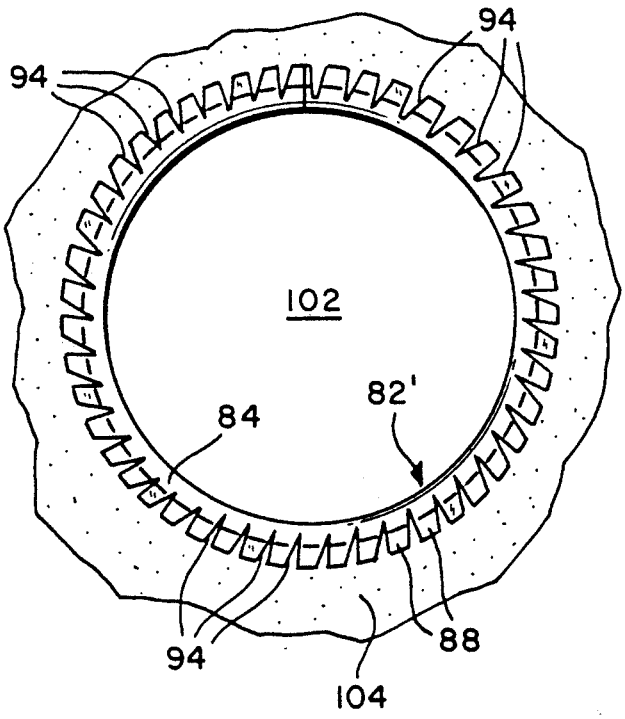
FIG. 7 illustrates another use of the drywall edge finishing strip of FIG. 5.

FIG. 7 illustrates another length 82' of the drywall edge finishing strip 80 which is formed into a complete circle of only about twelve inches in diameter. The length 82' of the drywall edge finishing strip 80 is suitable for finishing the exposed edge of a circular porthole opening 102 in a wall surface 104. As with the length 82, the tabs in the flange 88 defined between the slits 94 spread outwardly progressively further apart as required proceeding from the central region 84 in order to follow the circular curvature defined by the opening 102. The pressure sensitive adhesive on the surfaces of the flanges 86 and 88 that are juxtaposed against the wall surfaces holds the length 82' of the drywall edge finishing strip 80 firmly against the Wall surfaces to which the finishing strip 80 is applied.

Figure 8:
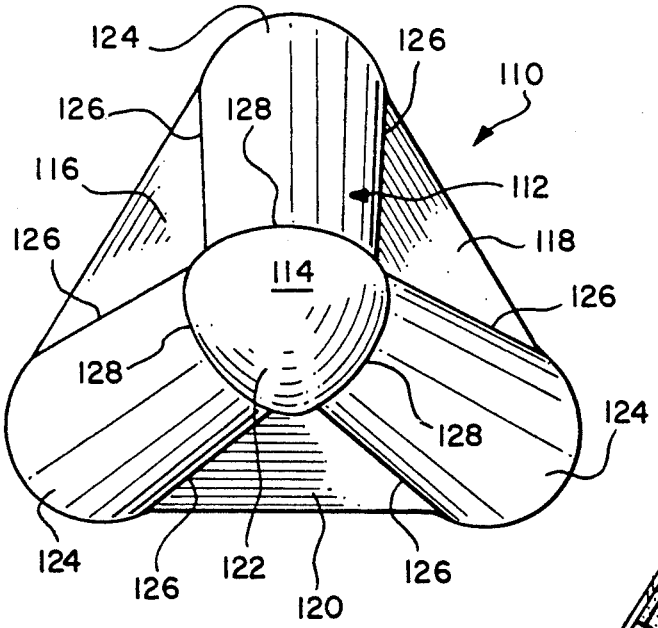
FIG. 8 is a plan view of the exterior Surface of a drywall edge finishing structure according to the invention for use in capping a corner.
Figure 9:
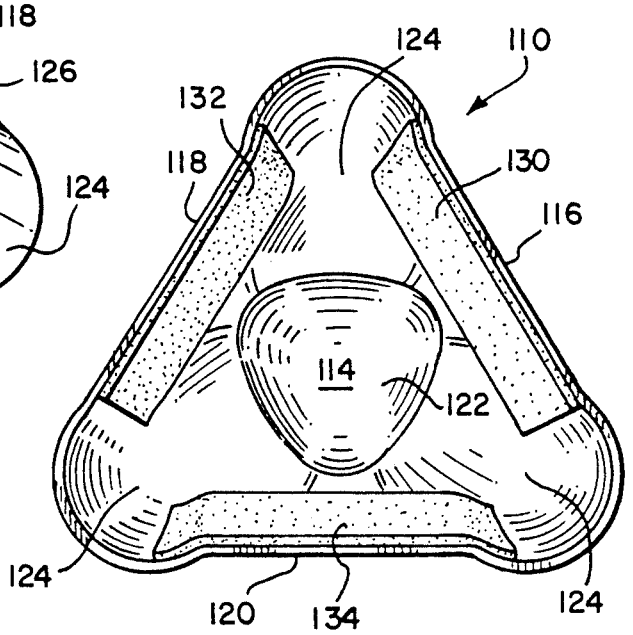
FIG. 9 is an opposite view of the obverse, concave surface of the cap of FIG. 8.

FIGS. 8 and 9 illustrate a drywall edge finishing structure 110 suitable for capping an exposed corner formed by three wall surfaces which intersect in mutually orthogonal fashion. The structure 110 is comprised of a stiff, water impervious plastic sheet 112 which defines a central curved region 114 and three flat, generally triangular-shaped flanges 116, 118 and 120. The curved central region 114 includes a generally spherically curved portion 122 and three generally cylindrically curved portions 124 that radiate from the spherically curved portion 122 between the flanges 116, 118 and 120. Linear abutment shoulders 126 are defined at the demarcations between the cylindrical portions 124 and the flat flanges 116, 118 and 120. Similarly, arcuate abutment shoulders 128 are defined between the cylindrical portions of the central region 114 and the spherical portion 122 thereof. The central region 114 of the drywall edge finishing structure 110 thereby stands out and away from the flanges 116, 118 and 120. The spherical portion 122 of the central region 114 stands out and away from the cylindrical portions 124 thereof. The abutment shoulders 126 and 128 thereby provide stops for different layers of paper drywall tape which can be used to blend the corner covering structure 110 into three orthogonally intersecting wall surfaces. Such wall surfaces typically form corners in kitchen soffits within buildings.

The concave underside of the drywall edge finishing structure 110 is depicted in FIG. 9. As illustrated, strips 130, 132 and 134 of a tape coated on both sides with pressure sensitive adhesive are secured to the underside surfaces of the flanges 116, 118 and 120, respectively. The drywall edge finishing structure 110 can thereby be placed as a cap on an exposed corner, such as a soffit corner, and will remain in position once pressed against the three orthogonal wall surfaces defining the corner.

A first layer of paper drywall tape can be positioned in overlapping relationship against the flanges 116, 118 and 120, and against the underlying wall surfaces, to reside in abutment against the tape guide abutment shoulder 126. Other layers of conventional paper drywall tape can be overlaid on these first layers and pass over the cylindrically curved surfaces 124 of the central region 114, as well as atop the first layer of paper drywall tape on the flanges 116, 188 and 120, to reside in abutment against the abutment shoulders 128. The drywall edge finishing structure 110 can thereby be smoothly blended into the wall surfaces upon which it is mounted, and forms a sound, attractive looking cap for an exposed corner. This cap will not crumble or deteriorate like corners formed merely of drywall or drywall covered with conventional paper drywall tape.

Undoubtedly, numerous variations and modifications of the invention will become readily apparent to those familiar with drywall construction and drywall construction materials and accessories. Accordingly, the scope of the invention should not be construed as limited to the specific embodiments of the invention depicted and described herein, but rather is defined in the claims appended hereto.

I claim:

1. A drywall edge finishing strip comprising an elongated length of stiff, water impervious plastic defining an elongated central transversely curved region and a pair of laterally and linearly directed flanges that extend in diverging fashion from said central curved region wherein each of said flanges has a wall contacting surface which is flat and planar throughout, and a layer of pressure sensitive adhesive on each of said wall contacting surfaces of each of said flanges wherein said adhesive layer extends longitudinally therealong throughout said length to establish intimate contact and adhesive bonding with a wall surface against which it is pressed.

2. A drywall edge finishing strip according to claim 1 wherein said flanges define a pair of mutually parallel longitudinal edges, and a multiplicity of mutually parallel slits are defined in one of said flanges at separated intervals along its length to extend transversely across said one of said flanges from the edge thereof through the adhesive strip mounted thereon and into said central region.

3. A drywall edge finishing strip according to claim 2 wherein said slits are longitudinally spaced from each other at intervals of approximately one and one-quarter inches.

4. A drywall edge finishing strip according to claim 2 wherein said slits are inclined at an angle relative to the longitudinal edge of the flange in which they are defined.

5. A drywall edge finishing strip according to claim 4 wherein said slits are inclined at an angle of about seventy degrees relative to said longitudinal edge of said flange in which they are defined.

6. A drywall edge finishing strip according to claim 5 wherein said slits extend more than half the distance across the entire width of said length of plastic.

7. A drywall edge finishing strip according to claim 1 wherein said flanges define a pair of mutually parallel longitudinal edges and wherein said plastic strip defines a longitudinally extending stiffening bead in said central region that extends parallel to said longitudinal edges.

8. A drywall edge finishing strip according to claim 1 wherein said length of plastic is configured so that said central region stands out away from said flanges and is delineated therefrom by parallel tape guide abutment shoulders on opposite sides of said central region.

9. A drywall edge finishing strip according to claim 1 wherein said flanges are tapered in thickness and are thickest adjacent said central region and thinnest remote therefrom.

10. A drywall edge finishing strip comprising an elongated length of stiff, water impervious plastic defining an elongated central transversely curved region and a pair of laterally and linearly directed flanges that diverge from said central curved region to define longitudinally extending edges wherein each of said flanges has a wall contacting surface which is flat and planar throughout, a layer of pressure sensitive adhesive on each of said wall contacting surfaces for firmly adhering to a wall surface against which it is pressed, and wherein one of said flanges is slit periodically throughout its length by a multiplicity of parallel slits that extend transversely from one of said longitudinally extending edges into said central region.

11. A drywall edge finishing strip according to claim 10 wherein said slits are longitudinally spaced from each other at intervals of approximately one and one-quarter inches.

12. A drywall edge finishing strip according to claim 10 wherein said slits are inclined at an angle relative to the longitudinal edge of the flange in which they are defined

13. A drywall edge finishing strip according to claim 12 wherein said slits are inclined at an angle of about seventy degrees relative to said longitudinal edge of said flange in which they are defined.

14. A drywall edge finishing strip according to claim 10 wherein said slits in said strip terminate within said central region at locations further from said one longitudinal edge from which then extend than from the opposite longitudinal edge.

15. A drywall edge finishing strip according to claim 10 further comprising layers of contact sensitive adhesive tape mounted on both of said flanges and extending longitudinally along the length of said plastic strip.

16. A drywall edge finishing strip according to claim 10 wherein said flanges are tapered in thickness and are thickest where they diverge from said central curved region and thinnest at said longitudinally extending edges.

17. A drywall edge finishing strip according to claim 10 wherein said plastic strip is configured so that said central region stands out away from said flanges and is delineated therefrom by tape guide abutment shoulders.

18. A drywall edge finishing structure comprising a stiff, water impervious plastic sheet defining a central curved region and a least a pair of flanges extending outwardly from said central region and at angles to each other wherein each of said flanges has a wall contacting surface which is flat and planar throughout, and a contact sensitive adhesive layer disposed on each of said wall contacting surfaces of each of said flanges, whereby said adhesive layers establish intimate contact with and adhesively bond to wall surfaces when pressed against such wall surfaces.

19. A dry wall edge finishing structure according to claim 18 wherein said structure defines three flanges and forms a cap for an exposed corner.

* * * * *